United States Patent [19]

Brisko

[11] Patent Number: 4,612,883

[45] Date of Patent: Sep. 23, 1986

[54] HYDRAULICALLY ACTUATED VALVE TRAIN FOR AN INTERNAL COMBUSTION ENGINE

[76] Inventor: Frank S. Brisko, Box 38, Ojibwa, Wis. 54862

[21] Appl. No.: 724,819

[22] Filed: Apr. 18, 1985

[51] Int. Cl.[4] ..... F01L 9/02

[52] U.S. Cl. ..... 123/90.13; 123/90.12

[58] Field of Search ..... 123/90.13, 90.12, 90.11

[56] References Cited

U.S. PATENT DOCUMENTS

| | | | |
|---|---|---|---|
| 1,903,328 | 4/1933 | Noble | 123/90.13 |
| 2,391,972 | 1/1946 | Hufford et al. | 123/90.13 |
| 2,602,434 | 7/1952 | Barnaby | 123/90.13 |
| 2,635,544 | 4/1953 | Lossau | 123/90.13 |
| 2,962,013 | 11/1960 | Reggio | 123/90.13 |
| 3,361,121 | 1/1968 | Schott | 123/90.13 |
| 3,534,718 | 10/1970 | Pasquin | 123/90.13 |
| 4,200,067 | 4/1980 | Trenne | 123/90.13 |

*Primary Examiner*—Ira S. Lazarus

*Attorney, Agent, or Firm*—Harness, Dickey & Pierce

[57] ABSTRACT

A hydraulically operated valve train for an internal combustion engine wherein the valves are opened and closed by means of a fluid operated piston. The fluid piston is, in turn, operated by a remotely positioned actuator consisting of a reciprocating plunger and valve member that sequentially operates so as to seal off the portion of the fluid circuit between the plunger and the fluid piston and then actuate the valve through the fluid piston.

4 Claims, 3 Drawing Figures

HYDRAULICALLY ACTUATED VALVE TRAIN FOR AN INTERNAL COMBUSTION ENGINE

BACKGROUND OF THE INVENTION

This invention relates to a hydraulically actuated valve train for an internal combustion and more particularly to an improved high efficiency device for such applications.

With the present emphasis on high specific outputs for internal combustion engines while at the same time maintaining good fuel economy and accurate control of emission of unwanted exhaust gas constituents, it is desirable to optimize all features of the engine. One of the features that is very limiting in engine performance is the valve train. Conventional valve trains employ a camshaft and a mechanical system that interconnects the cam lobes with the poppet type valves for actuating the valves. The mechanical complexity of such devices is believed to be obvious.

In addition to the mechanical complexity, the mechanically operated systems have presented certain limitations as to the speed at which the valves may be opened and closed and also as to the effective valve timing. In addition, the clearances of the mechanism, which may vary during running conditions such as under temperature changes, make it accurate to control the valve operation under all of these circumstances.

To offset many of these deficiencies, it has been proposed to provide a hydraulic system wherein the valves are actuated hydraulically. Such an arrangement is shown in U.S. Pat. No. 2,306,131, entitled "Hydraulic Valve Lifting Mechanism", issued Dec. 22, 1942. The arrangement shown in that patent provides an extremely good valve actuating mechanism that offsets many of the disadvantages noted above. However, this device employs a mechanically operated plunger that pressurizes hydraulic fluid, namely lubricating oil, and delivers it to a fluid motor that is associated with the individual valves for operating the valves. The plunger is supplied with lubricating oil under pressure which is, in turn, delivered through a distributor arrangement. The plunger serves two functions in the arrangement shown in that patent. First, it operates as the pressurizing device and second, it operates as a valve so as to cut off the communication of the chamber in which the plunger reciprocates from the remainder of the distributor so as to trap the fluid in the line that leads to the valve. Where these two functions are combined in a single device, there are several disadvantages that result. Specifically, the maximum opening and closing rates are compromised and furthermore the lift of the valve cannot be controlled as accurately as desired. In addition, certain problems may be experienced on starting up.

It is, therefore, a principal object of this invention to provide an improved valve actuating mechanism for an internal combustion engine.

It is another object of this invention to provide an improved hydraulic valve actuating mechanism for an internal combustion engine wherein the sequence of valve events may be accurately controlled under all running conditions.

SUMMARY OF THE INVENTION

This invention is adapted to be embodied in a hydraulically actuated valve train for an internal combustion engine that includes a poppet valve that is supported for reciprocation for controlling the communication of a port with a chamber of the engine. A fluid actuated piston is associated with the poppet valve for operating the poppet valve and a remotely positioned actuator device is incorporated for supplying fluid under pressure to the fluid piston. The actuator device comprises means that define a fluid chamber and means that deliver fluid under pressure to the chamber. A bore communicates with the fluid piston for delivery of fluid to the fluid piston. A plunger is slidably supported in the bore for pressurizing the fluid in the bore. Valve means are provided that selectively communicate the bore with the fluid chamber and for isolating the bore from the fluid chamber. Means are incorporated that cyclically and sequentially close the valve for isolating the bore from the fluid chamber and for moving the plunger in the bore for pressurizing the fluid piston and actuating the poppet valve.

DETAILED DESCRIPTION OF THE PREFERRED EMBODIMENT

Figure 1:
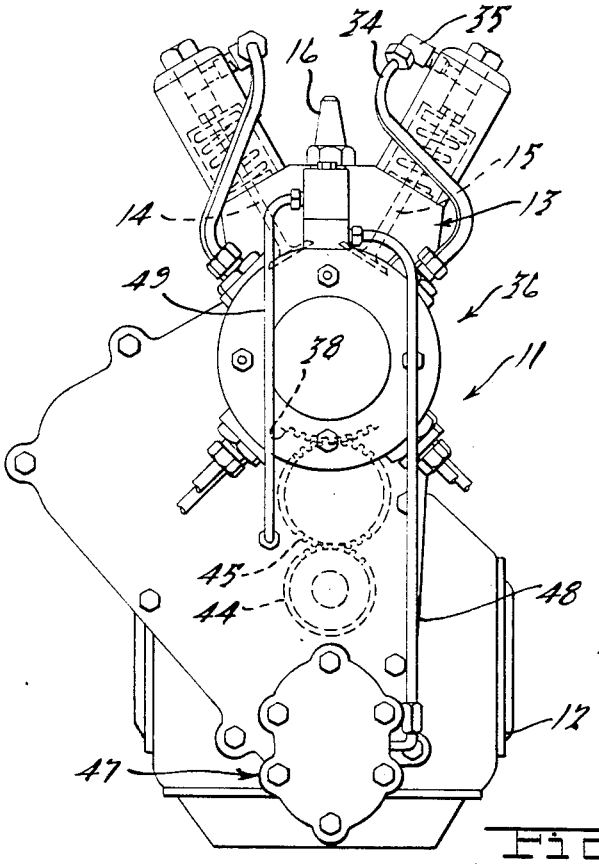
FIG. 1 is a front elevational view of an internal combustion engine constructed in accordance with an embodiment of the invention.

Referring now in detail to the drawing, an internal combustion engine constructed in accordance with an embodiment of the invention is identified generally by the reference numeral 11. The engine 11 is of the reciprocating type embodying poppet valves for controlling the flow of an intake and exhaust charge to and from the combustion chamber or combustion chambers of the engine. The engine 11 may be of any known type configuration and includes a crankcase 12 in which the crankshaft rotates and which may be filled with lubricant. A cylinder block is affixed to the crankcase and defines one or more cylinder bores that may be configured in any desirable orientation, such as inline, V type, opposed or so on. A cylinder head assembly, indicated generally by the reference numeral 13, is affixed to the cylinder block, and if the engine has a plurality of cylinder banks, there may be incorporated individual cylinder heads 13 for each cylinder bank. As has been noted, the basic construction of the engine forms no part of the invention and, therefore, the internal details of the components thus far described are not deemed to be necessary to the understanding of the invention.

Supported at one side of the cylinder head assembly 13 for reciprocation are intake poppet valve assemblies 14 that control the flow of an inlet charge that is supplied by a suitable charge former and manifold (not shown) to the engine combustion chamber. At the opposite side of the cylinder head 13, there are disposed exhaust poppet valves, indicated by the reference numeral 15, which control the discharge of the exhaust products from the combustion chambers to the atmosphere through an appropriate exhaust manifold. A spark plug 16 is positioned within each combustion chamber and supported by the cylinder head 13 for firing the charge at the appropriate timing, in a known manner.

Figure 2:
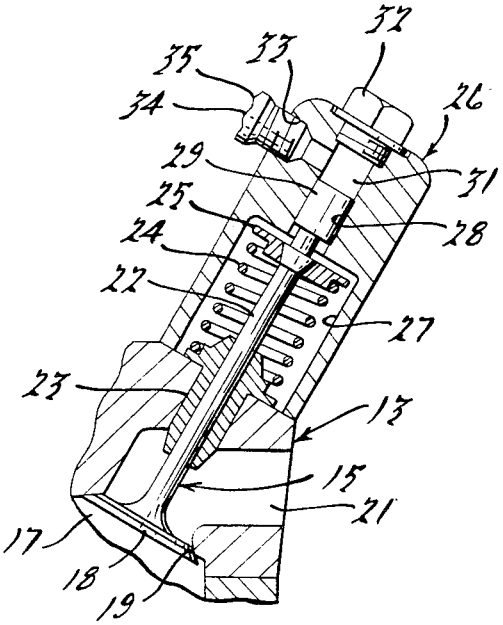
FIG. 2 is an enlarged cross-sectional view showing one of the poppet valves and its actuating structure.

The combustion of the intake and exhaust valves 14 and 15 and their manner of actuation may be best understood by reference to FIG. 2. Inasmuch as the construction and operation of the intake valves 14 and exhaust valves 15 is the same, only the construction associated with one of the exhaust valves 15 is illustrated in FIG. 2. It is believed to be obvious to those skilled in the art how the invention is applied to the actuation and operation of the intake valves 14.

The cylinder head 13 has individual cavities 17 that cooperate with the associated cylinder block, cylinder bore and piston to form the combustion chambers. The exhaust valves 15, as has been noted, are of the poppet type and have heads 18 that cooperate with valve seats 19 so as to control the flow through exhaust ports 21. The valves 15 further include stems 22 that are slidably supported in the head 13 by means of valve guides 23 that may be pressed or otherwise fixed in place.

A coil compression spring 24 encircles the upper portion of each valve stem 22 and acts against a keeper assembly 25 and the upper surface of the cylinder head 13 so as to force the valves 15 toward their closed position.

Unlike conventional engines, a camshaft or other mechanical actuating mechanism is not employed for opening the valves 14 and 15 in opposition to the action of the springs 24. For this purpose, a cover assembly, indicated generally by the reference numeral 26, is affixed to the cylinder head 13 and has an internal cavity 27 that contains the upper portion of the valve stem 22, valve spring 25 and keeper 25.

The cover assembly 26 is formed with a plurality of bores 28, each of which is aligned with the upper end of a tip of a respective valve stem 22. A piston 29 is slidably supported within the bore 28 and is adapted to engage the tip of the associated valve stem 22. The area above the piston 29 in the bore 28 comprises a chamber 31 of a fluid motor. The bores 28 are closed at their upper ends by cap plugs 32 so that the chambers 31 are effectively sealed.

A cross-drilled and tapped passageway 33 is formed in the casting 26 for each bore 28 and chamber 31. A fluid conduit 34 extends to each of these chambers 31 and is connected thereto by means of a fitting 35.

Figure 3:
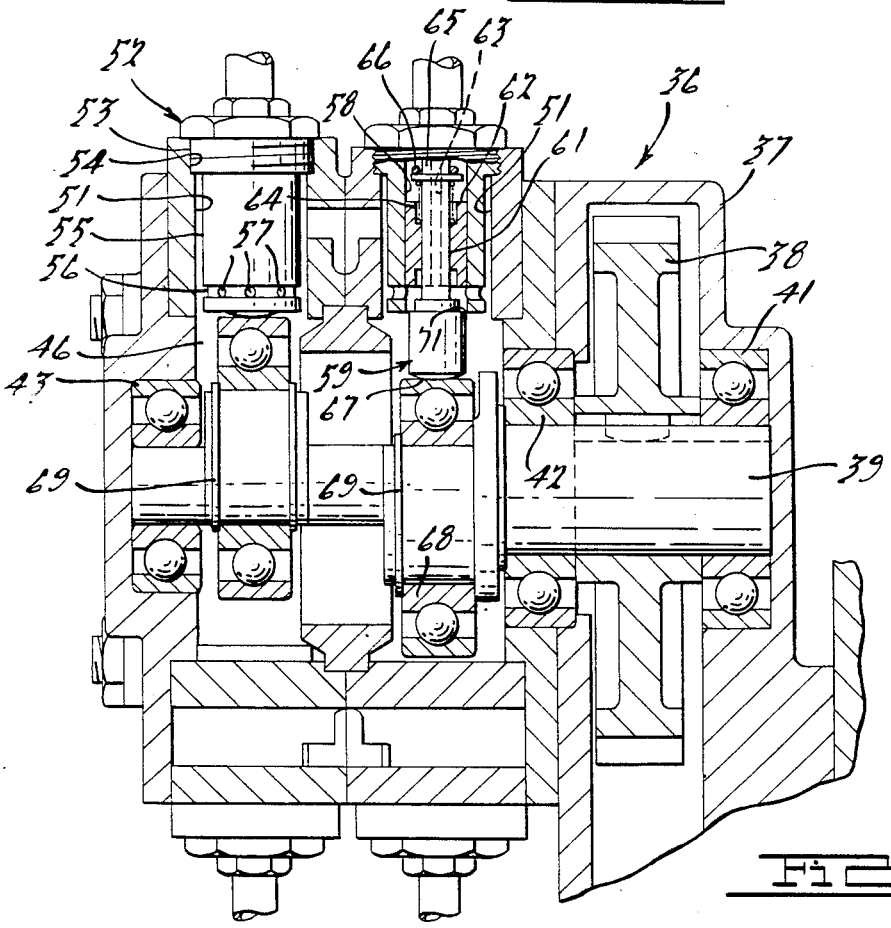
FIG. 3 is an enlarged cross-sectional view taken through the actuator device.

The conduits 35 and chambers 31 are sequentially pressurized and depressurized under the control of a distributor and actuator mechanism, indicated generally by the reference numeral 36 and shown in most detail in FIG. 3. The mechanism 36 includes an outer housing assembly 37 having a drive portion in which a driving gear 38 is positioned. The driving gear 38 is affixed to a shaft 39 that is rotatably journaled within the housing 37 on spaced bearings 41, 42 and 43. The gear 38 and shaft 39 are driven at one-half crankshaft speed by means of a gear train consisting of a first gear 44 that is affixed to the crankshaft, a second gear 45 which is in mesh with the gear 44 and which in turn drives the gear 38 at the aforenoted speed ratio.

The housing assembly 37 defines a main fluid cavity 46 that is supplied with fluid under pressure. In the illustrated embodiment, this fluid comprises the lubricating of oil of the engine. For this purpose, the lubricant pump 47, which is mounted at the front of the crankcase 12 and is appropriately driven by the crankshaft, has an output line 48 that extends to the housing 37 and in communication with the cavity 46. The lubricant from the cavity 46 may be returned to the crankshaft 12 or circulated through the remainder of the engine. In the illustrated embodiment, a return line 49 (FIG. 2) is provided for this purpose.

The housing 37 is provided with a plurality of radially extending bores 51 that intersect and communicate with the cavity 46. The angular spacing of the bores 51 about the axis of rotation of the shaft 39 and then number of such bores is determined by the number of intake and exhaust valves 14, 15 and the firing order and valve timing of the engine. That is, the bores 51 are arranged so that the valves 14 and 15 will be opened in the desired sequence, as should be apparent to those skilled in the art.

Received within each of the bores 51 is a combined plunger, valve assembly, indicated generally by the reference numeral 52 which is comprised of an outer housing having a threaded portion 53 that is threaded into a tapped opening 54 formed at the outer end of each bore 51. The housing has a reduced diameter cylindrical portion 55 that is spaced inwardly from the bore 51 so as to provide a clearance area therebetween through which the pressurized oil delivered by the pump 47 may flow.

The lower part of the cylindrical portion 55 is provided with an annular relief 56 through which radially extending passages 57 extend so as to permit oil to flow into a bore 58 formed in the interior of the housing portion. A plunger, indicated generally by the reference numeral 59, is supported within this bore 58 and has a reduced diameter shank portion 61 that is, in turn, slidably supported within a valve sleeve 62. The shank portion 61 is formed with one or more radially extending openings that afford fluid flow through them into a bored passage 63 extending through the plunger 59 and terminating at an opening in its upper end. This opening communicates with a cavity formed at the upper end of the bore 58.

A first, relatively light coil compression spring 64 encircles the plunger portion 61 and a shoulder 65 formed thereon so as to urge the valve sleeve 62 downwardly relative to the plunger 59 and against a fixed stop carried by the housing 37. A larger heavier spring 66 engages the upper end of the shoulder 65 and a shoulder formed within the housing so as to urge the plunger 59 downwardly along with the sleeve 62.

The lower surface of the plunger 59 is generally spherical in shape, as at 67, and engages the outer race of a bearing assembly 68. The bearing assembly 68 is received on an eccentric 69 of the shaft 39 so upon rotation of the shaft, the plunger 59 will be reciprocated to actuate the respective valve 14 or 15.

The device operates in the following manner. As the engine is running, the lubricating pump 47 will deliver lubricant under pressure through the line 48 to the cavity 46. Assuming that the respective valve is in its closed position, as with the right hand upper plunger shown in FIG. 3, the fluid under pressure may flow through the relief 56 and passageways 57 and opening in the plunger 59 to its internal passageway 65. Hence, the conduits 34 and chambers 31 above the pistons 29 will be maintained under lubricant system pressure. This pressure is not sufficient so as to effect opening of the individual valve but will eliminate any clearance between the piston 29 and the tip of valve stem 22.

As the shaft 39 continues to rotate, the race of the bearing 68 will exert a lifting force on the plunger 59 which will cause the plunger 59 to tend to move upwardly. During this upward movement, the spring 64 will exert sufficient force on the valve sleeve 62 to hold it in its lowered position. Thus, initial movement is effective to close off the passageways in the plunger 59 that communicate the chamber 46 with its internal passageway 65 and the valving function will operate first and before the fluid in the bore 58 above the sleeve 62 and plunger 59 is pressurized by upward movement of the plunger 59. Once the closure is completed, a shoulder 71 formed on the plunger 59 will engage the valve sleeve 62 and cause the valve sleeve 62 to move upwardly with the plunger 59. This will pressurize the oil in the bore 58 and transmit this pressurized fluid through the conduit 34 to the chamber 31 so as to effect opening of the respective valve.

When the shaft 39 continues to rotate, the plunger 59 will begin its downward movement and the springs 66 and 64 will cause the plunger 59 and valve sleeve 62 to follow and reduce the pressure in the bore 58. The valve spring 24 will then urge the valve 15 and piston 29 upwardly toward their closed position. This condition continues until the sleeve 62 bottoms on a shoulder formed at the lower end of the bore 58 and then the plunger 59 will continue its downward movement thus opening the communication with the chamber 46.

It should be readily apparent from the foregoing description that the device operates in a highly effective manner and is effective to sequentially close off the communication of the fluid with the conduit connecting the plunger with the actuating piston 29 and then pressurizing this fluid so as to open the respective valve.

Although an embodiment of the invention has been illustrated and described, various modifications may be made without departing from the spirit and scope of the invention, as defined by the appended claims.

I claim:

1. A hydraulically actuated valve train for an internal combustion engine comprising a poppet valve supported for reciprocation for controlling the communication of a port with a chamber of said engine, a fluid actuated piston associated with said poppet valve for operating said poppet valve, and a remotely positioned actuator device for supplying fluid under pressure to said fluid piston, said actuator device comprising a housing defining a fluid chamber and having a bore, means for delivering fluid under pressure to said chamber, said bore communicating with said fluid piston for delivering fluid thereto, a plunger supported in said bore for pressurizing the fluid in said bore, valve means comprising a sleeve slidably supported on said plunger and within said bore for selectively communicating a chamber formed in said bore above said valve sleeve and said plunger with said fluid chamber and for isolating said bore from said fluid chamber, and means for cyclically and sequentially closing said valve for isolating said bore from said fluid chamber and for moving said plunger in said bore for pressurizing said fluid piston and actuating said poppet valve, comprising a first relatively light spring means interposed between said plunger and said valve sleeve for urging the valve sleeve toward a closed position and a second relatively heavier valve spring means acting on said plunger for urging said plunger into engagement with an actuating member for effecting reciprocation of said plunger and said valve sleeve.

2. A hydraulically actuated valve train as set forth in claim 1 further including a lubricant pump for the engine, the means for delivering fluid under pressure to the chamber comprising means for communicating the output of the lubricant pump to the chamber for delivering pressurized lubricant to the chamber.

3. A hydraulically actuated valve train as set for in claim 1 wherein the engine has a plurality of poppet type intake valves and a plurality of poppet type exhaust valves each operated hydraulically.

4. A hydraulically actuated valve train as set forth in claim 1 further including a cover affixed to the engine and overlying the stem of the poppet valve, the fluid piston being slidably supported within a bore formed in said cover.

* * * * *